US006079760A

United States Patent [19]

Khachaturian

[11] Patent Number: 6,079,760

[45] Date of Patent: Jun. 27, 2000

[54] SPREADER BAR APPARATUS

[76] Inventor: Jon E. Khachaturian, 5827 Rhodes Ave., New Orleans, La. 70131

[21] Appl. No.: 09/104,513

[22] Filed: Jun. 25, 1998

Related U.S. Application Data

[63] Continuation-in-part of application No. 08/710,870, Sep. 23, 1996, Pat. No. 5,863,085.

[51] Int. Cl.[7] ..... B66C 1/12

[52] U.S. Cl. ..... 294/81.1; 294/81.5; 294/74

[58] Field of Search ..... 294/81.1, 81.2, 294/81.21, 81.5, 81.6, 74, 1.1, 81.54, 81.62

[56] References Cited

U.S. PATENT DOCUMENTS

| | | | |
|---|---|---|---|
| 2,730,398 | 1/1956 | Huested | 394/1.1 |
| 2,801,127 | 7/1957 | Koons et al. | 294/81.2 |
| 4,397,493 | 8/1983 | Khachaturian | 294/81 R |
| 4,909,555 | 3/1990 | Blasi | 294/81.1 |
| 5,603,544 | 2/1997 | Bishop et al. | 294/81.1 |
| 5,716,088 | 2/1998 | Chander et al. | 294/81.1 |

FOREIGN PATENT DOCUMENTS

| | | | |
|---|---|---|---|
| 209347 | 1/1957 | Australia | 294/74 |
| 1101157 | 1/1968 | United Kingdom | 294/81.21 |

*Primary Examiner*—Dean J. Kramer
*Assistant Examiner*—Paul Chin
*Attorney, Agent, or Firm*—Garvey, Smith, Nehrbass & Doody, LLC

[57] ABSTRACT

A spreader bar apparatus of improved configuration is comprised of a plurality of bar sections including at least a pair of bar sections that are connectable end-to-end to form a lifting bar with a central longitudinal axis and with left and right bar end members, each removably attachable to the lifting bar that is comprised of the two bar sections. A plurality of transverse annular faces are provided respectively on the bar sections and on the bar end members for transferring axial load along the bar central axis and in between the various bar sections and end members during a lift. A plurality of connecting portions provided on the bar sections and bar end members form detachable connections between the bar sections and between each bar end member and a bar section. The apparatus of the present invention is so configured that a majority of load is carried by the annular faces as opposed to the connecting portions. For example, threaded connections can be used to assemble the bar sections and end members together. However, the thread sections are loosely connected until the annular faces abut one another so that a full engagement of the threads is not realized and the annular faces carry substantially all or most of the load.

33 Claims, 4 Drawing Sheets

SPREADER BAR APPARATUS

CROSS-REFERENCE TO RELATED APPLICATIONS

This is a continuation-in-part of U.S. Ser. No. 08/710,870, filed Sep. 23, 1996, and entitled "SPREADER BAR ASSEMBLY" now U.S. Pat. No. 5,863,085.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to lifting apparatus and accessories, and more particularly to an improved spreader bar lifting apparatus for use with cranes and other lifting devices that use slings. Even more particularly the present invention relates to an improved multi-part spreader bar arrangement that includes a plurality of connectable sections including at least a pair of bar sections and a pair of end members, and wherein the detachable connections between the sections are provided with annular load bearing faces that carry a majority of the axial compressive load during use.

2. General Background of the Invention

Spreader bars are commonly used in industry for lifting large objects with a single hook that is attached to the crown block and lift cables of a crane. A lifting hook is commonly provided with a pair of slings that depend from the crane hook at angles in a bridle fashion, each of the slings connecting to an end portion of the spreader bar. Parallel, depending lift lines are then suspended from the end portions of the spreader bar downwardly to the load that is to be lifted. An example of a spreader bar that has been patented can be seen in my prior U.S. Pat. No. 4,397,493, and entitled "Spreader Bar Assembly".

One of the problems with spreader bars is that of sizing the spreader bar to meet a particular load. Some devices have attempted to provide telescoping sections in order to adjust the spreader bar to different lengths so as to accommodate different loads. Such a telescoping, locking spreader bar operates well for relative light loads of a few thousand pounds. However, in the lifting of extremely heavy objects such as, for example, 25–50 tons, a much more rugged construction is required.

Another problem that faces the user of a spreader bar is that of transporting the bar from one place to another at a construction facility, fabrication yard, plant, shop, or the like. Most spreader bars are extremely heavy when compared to the strength of an average worker. To lift a very heavy object, one has typically needed a very heavy spreader bar. This creates a hazardous condition when workers attempt to move a very heavy spreader bar from one location to another.

BRIEF SUMMARY OF THE INVENTION

The present invention provides an improved spreader bar apparatus that can lift very heavy loads and at the same time be constructed of relatively lightweight material so that a high ratio is provided of load capacity to spreader bar weight.

This solves the problem of providing a very high capacity spreader bar that can be moved from one location to another by a worker or a few workers and avoiding the risk of injury.

The present invention provides a spreader bar apparatus of improved construction that can be disassembled for transport to remote locations using less expensive transportation means such as parcel service, mails, or the like.

The present invention provides an improved spreader bar apparatus that is constructed of a plurality of bar sections and a plurality of end members that are attachable end-to-end to form a single, rugged spreader bar assembly.

In the preferred embodiment, the plurality of bar sections and end members are attached using removable (preferably threaded) connections to assemble the bar sections and end members end-to-end.

In order to prevent substantial stress at the interface between one threaded section and another, the present invention provides transverse annular faces for transferring axial load along the bar central axis and in between the connected bar sections and bar end members. These load transfer faces preferably carry at least half of the load (and preferably substantially all of the load) so that the threads are not damaged during use.

The spreader bar apparatus of the present invention thus provides an improved spreader bar apparatus having a load carrying capacity and a bar weight, with the ratio of the load carrying capacity to the bar weight being between about 800 to 1 and 1200 to 1.

The bar and bar end members are preferably of a material having a density of between about 150 and 200. In the preferred embodiment, the bar sections and bar end members are of an aluminum material or an aluminum alloy. A carbon composite could also be used.

The interconnections between bar sections and end members is preferably a threaded type connection. However, other types of detachable connections can be used to assemble bar sections together and end members to bar sections such as, for example, bayonet-type connections or taper lock or wedge lock type connections.

The present invention provides an improved spreader bar apparatus with annular load carrying faces that can in fact carry substantially all of the axial load in the bar during a lift, thus insulating the connecting portions (for example, threads) from substantial stress during the lift.

The apparatus of the present invention includes end members that have sling receiving portions for enabling slings to be rigged to the bar end members.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 2:
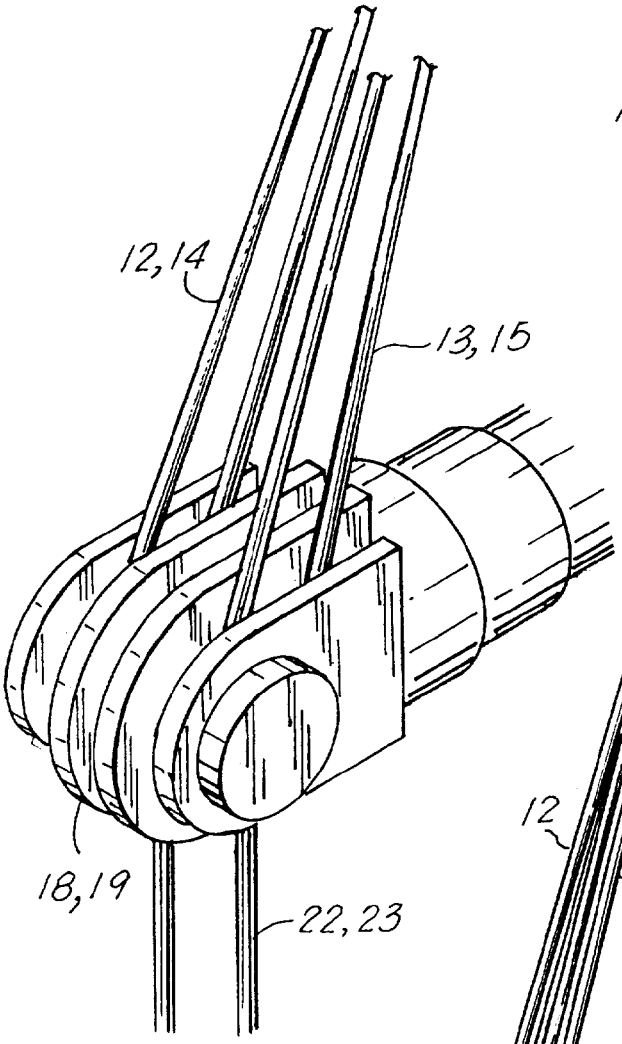
FIG. 2 is a perspective fragmentary view of the preferred embodiment of the apparatus of the present invention illustrating the end member portions thereof.
Figure 1:
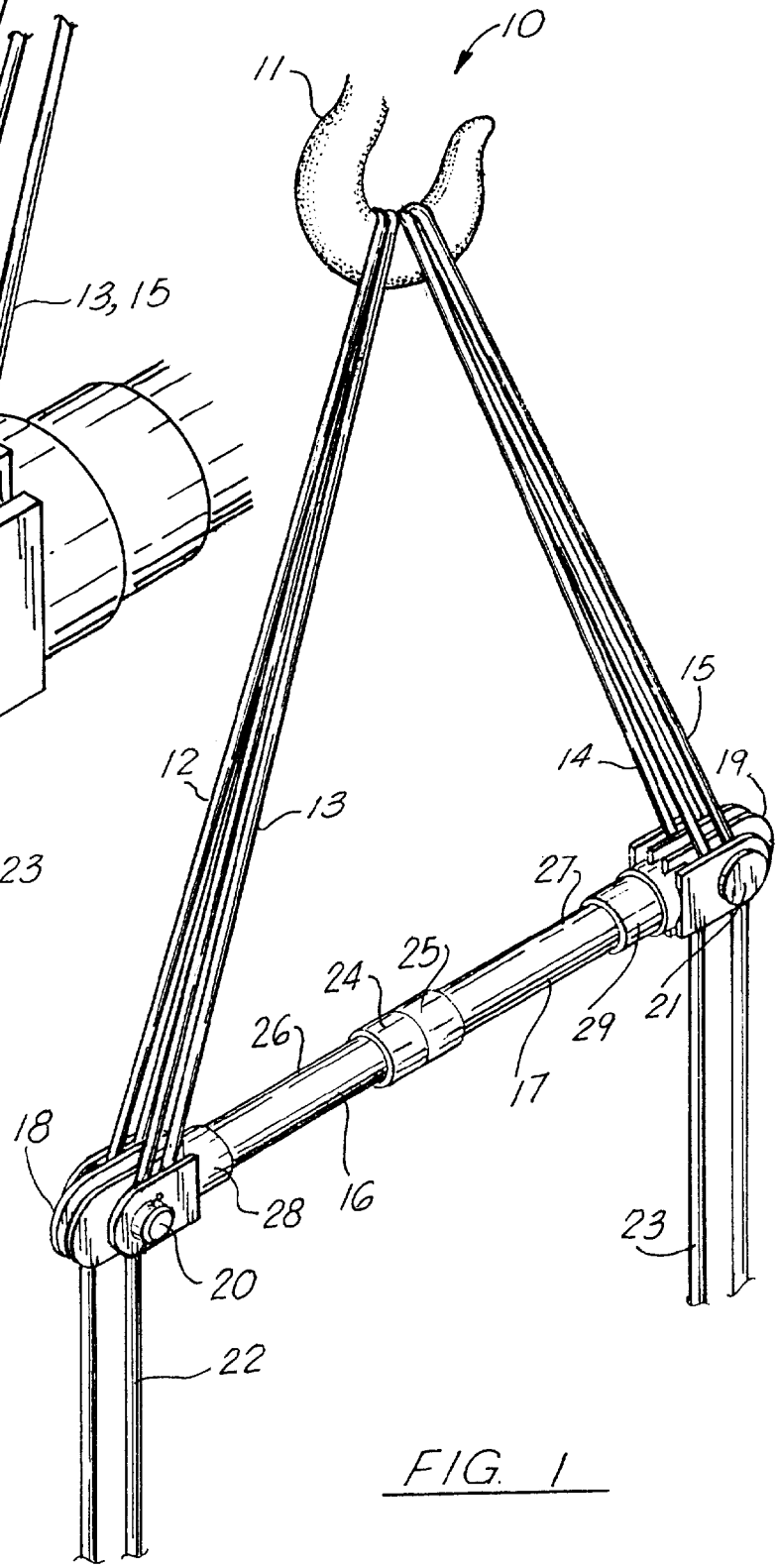
FIG. 1 is a perspective view of the preferred embodiment of the apparatus of the present invention.
Figure 3:
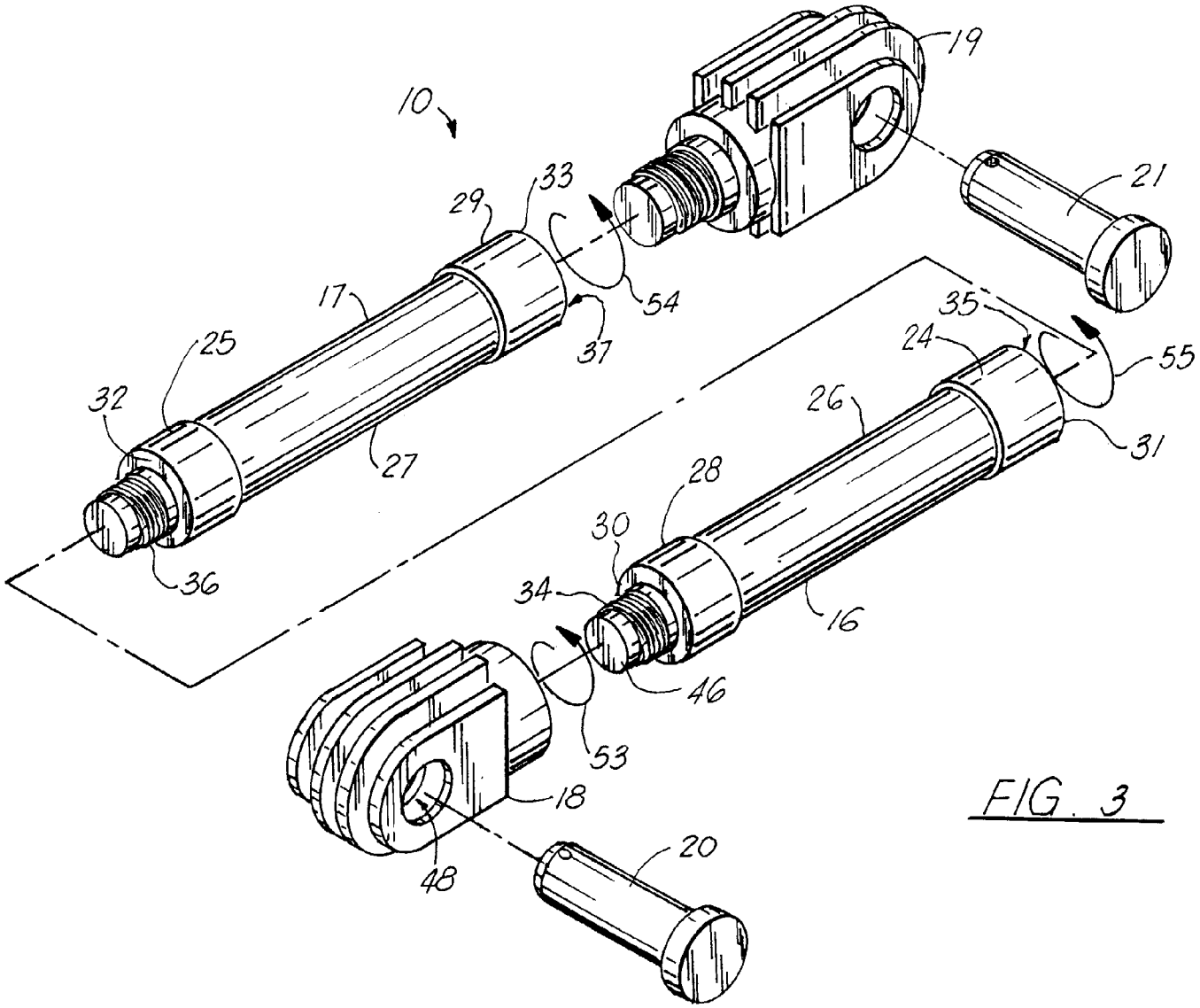
FIG. 3 is an exploded perspective view of the preferred embodiment of the apparatus of the present invention.
Figure 4:
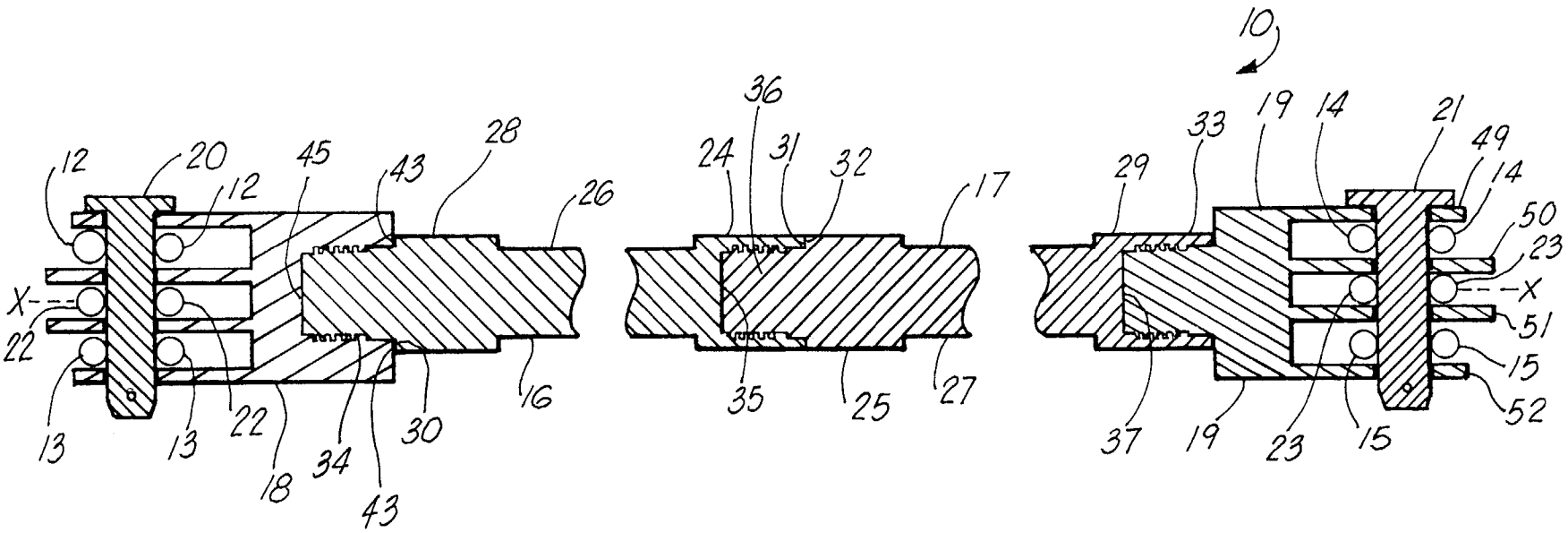
FIG. 4 is a top, sectional view of the preferred embodiment of the apparatus of the present invention.
Figure 5:
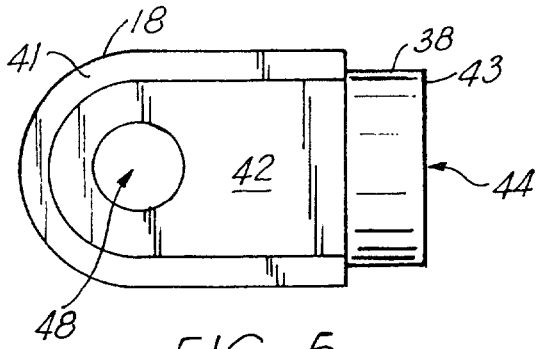
FIG. 5 is a side elevational view of the preferred embodiment of the apparatus of the present invention illustrating one of the end members having a female socket portion thereon.
Figure 6:
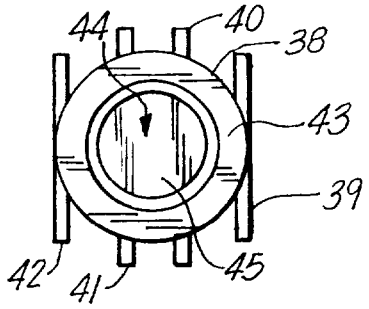
FIG. 6 is an end view of the end member of FIG. 5.

FIGS. 1–4 show generally the preferred embodiment of the apparatus of the present invention designated generally by the numeral in FIGS. 1, 3, and 4. Spreader bar apparatus 10 is shown in FIG. 1 attached to a crane lifting hook 11 with a plurality of slings 12–15. Such slings 12–15 are known in the art and are constructed of a number of different materials such as wire rope, polymeric woven plastic, plastic webbing, and like materials.

The apparatus 10 includes a plurality of connectable bar sections 16, 17 that are connected end-to-end. End members 18, 19 are assembled respectively to the bar sections 16 and 17 as shown in FIGS. 1, 3, and 4. Each end member 18, 19 can be constructed of a body with a plurality of plates having openings through which a pin 20 or 21 can be inserted as shown in FIGS. 1, 2, 3, and 4. The particular construction of the end members 18, 19 is shown in FIGS. 5–12.

In FIG. 1, a pair of slings 12, 13 are rigged to end member 18. Pin 20 extends through openings 48 and plates 39, 40, 41, 42. Slings 14 and 15 are rigged to end member 19. The pin 21 extends through opening 48 in plates 49, 50, 51, 52 of end member 19. In FIG. 4, the pins 20, 21 can be single pin members that extend through openings 48 in the respective plates of end members 18, 19 as shown.

Depending slings 22 and 23 are rigged at the center of each pin 20, 21 as shown in FIG. 4. The slings 12 and 13 are rigged on opposing sides of the sling 22. For the end member 19, the slings 14, 15 are rigged on opposite sides of the sling 23 as shown. Each of the slings is positioned in between a pair of adjacent plates of the respective end members 18 and 19. The sling 12 is in between plates 39 and 40. The sling 22 is in between the plates 40 and 41. The sling 13 is in between the plates 41 and 42.

An assembly of the bar sections 16, 17, 18, 19 can be seen in FIG. 4. The bar section 16 includes larger diameter section 24, smaller diameter section 26, and larger diameter section 28. The bar section 17 includes larger diameter section 29, smaller diameter section 27, and enlarged diameter section 25. The enlarged diameter sections provide annular transverse faces that are load bearing faces for transferring substantially all of the axial load from one bar section 16 to the next bar section 17 along the central longitudinal axis of the bar apparatus 10, designated by the dotted line X—X in FIG. 4. Further, annular transverse load carrying faces are used to transfer load in between a bar section 16 and its end member 18. Transverse faces are used to transfer load between bar section 17 and its end member 19. These annular transverse faces are seen more particularly in the detailed views of FIGS. 3 and 5–12.

In FIGS. 3 and 5–12, the bar section 16 provides an annular transverse face 30 and opposite annular transverse face 31. The bar section 17 provides an annular transverse face 32 and opposite annular transverse face 33. The bar section 16 provides an externally threaded projecting portion 34 next to annular transverse face 30.

An internally threaded socket 35 is provided at the end of bar section 16 opposite projecting portion 34. The bar section 17 provides an externally threaded projecting portion 36 at one end portion thereof and an internally threaded socket 37 at the other end portion thereof as shown in FIGS. 3 and 4.

Each of the end members 18 and 19 provides connecting portions that form threadable connections in the preferred embodiment with the ends of the assembled bar sections 16 and 17, as shown in FIGS. 3 and 4. End member 18 as shown in FIGS. 5–8 is formed of a body 18 and a plurality of plates 39, 40, 41, 42 extending therefrom as shown in FIGS. 5–8. A transverse annular face 43 forms a load transfer interface with a correspondingly shaped transverse annular face 30 of bar section 16 as shown in FIG. 4.

The end member 18 has an internally threaded socket 44 that includes a circular transverse face 45. The transverse circular face 45 registers against a correspondingly shaped flat surface 46 of projecting end portion 34 of bar section 16 as shown in FIGS. 3 and 4. These circular transverse faces 45 and 46 engage one another when the bar is operating for transferring load there between. Similarly, the other abutting annular transverse faces transfer load during a lift. The threads on the projecting end portions and on the sockets of the various end members and bar sections are configured to loosely assemble the bar sections 16, 17 and end members 18, 19 together end-to-end as shown in FIG. 4. In this fashion, the transverse annular faces and circular transverse faces carry substantially all of the load thus insulating the threads from substantial stress. In the preferred embodiment, these transverse annular faces and the circular transverse faces carry at least half (and preferably all) of the load.

Figure 7:
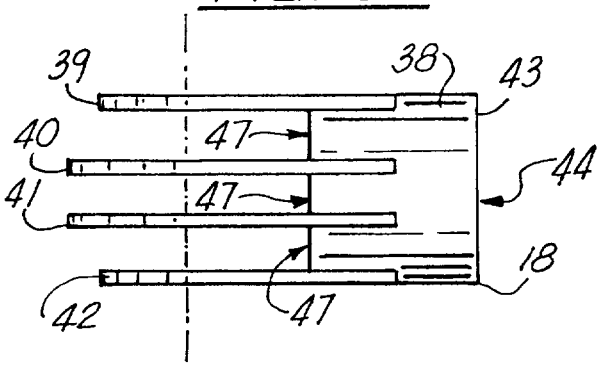
FIG. 7 is a top view of the end member of FIGS. 5–6.
Figure 8:
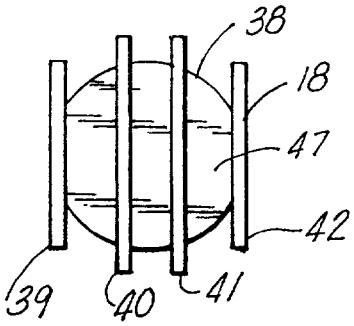
FIG. 8 is an end view of the end member of FIGS. 5–7.
Figure 9:
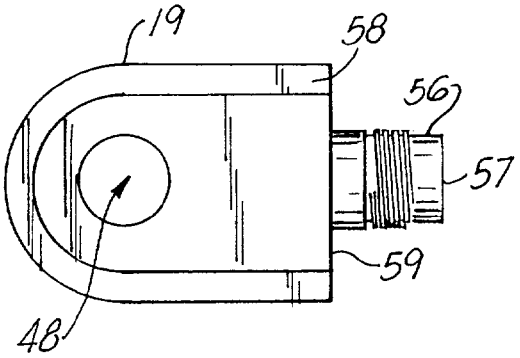
FIG. 9 is a side elevational view of the preferred embodiment of the apparatus of the present invention illustrating an end member portion thereof having a projecting connector member.
Figure 10:
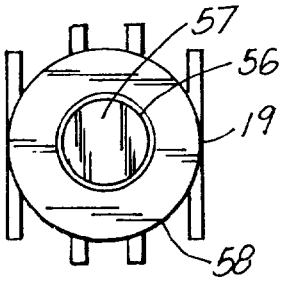
FIG. 10 is an end view of the end member of FIG. 9.

A flat surface 47 of body 38 communicates with the plurality of plates 39, 40, 41, 42 as shown in FIGS. 5–8. This provides recesses next to the flat surface 47 and in between the various plates 39, 40, 41, 42 as shown in FIGS. 7 and 8. As shown in FIG. 4, the slings 12–15 and 22–23 are rigged in the spaces provided in between the plates 39–42 of end member 18 and in between the plates 49, 50, 51, 52 of the end member 19 shown in FIGS. 9–12.

In FIGS. 9–12, the end member 19 is constructed similarly to the end member 18 of FIGS. 5–8, the difference being the providing of a projecting connecting portion 56 having a transverse circular face 57. This projecting portion 56 forms a threaded connection with the internally threaded socket 37 of bar section 17 as shown in FIG. 4. End member 19 is thus comprised of a body 58 having a projecting portion 56 extending therefrom at generally right angles to annular transverse face 59.

Figure 11:
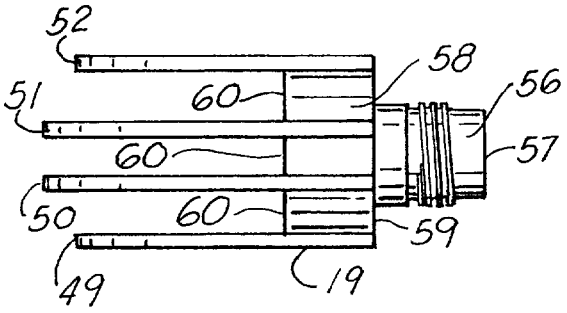
FIG. 11 is a top view of the end member of FIGS. 9–10.
Figure 12:
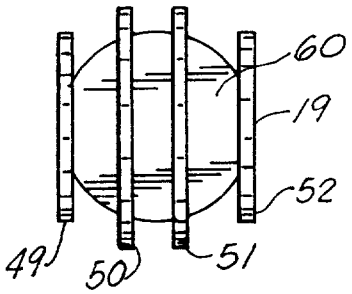
FIG. 12 is an end view of the end member of FIGS. 9–11.

Body 58 provides a flat surface 60 from which a plurality of plates 49, 50, 51, 52 extend at generally right angles as shown in FIGS. 11 and 12. These plurality of plates 49, 50, 51, 52 provide spaces there between that enable slings 14, 15 and 23 to be rigged to the pin 21 that extends through opening 48 as shown in FIGS. 3–4 and 9–12.

The circular arrows 53, 54, 55 in FIG. 3 schematically represent the circular motion of each of the bar sections 16 and 17 when they are threadably connected together (see arrow 55) and a connection of an end member 18 to bar section 16 (see arrow 53) and the connection of end member 19 to bar section 17 (see arrow 54).

The present invention provides a great load carrying capacity for enabling spreader bar 10 to lift a large amount of weight when compared to the weight of the bar 10 itself. Because of the particular construction of the apparatus of the present invention, relatively lightweight metals or like materials can be used in its construction, for example, so that a very high ratio exists between the load carrying capacity of a bar and its bar weight. In the preferred embodiment, this ratio is about 1000 to 1. As an example, an aluminum bar has been constructed in accordance with the aforedescribed specification and drawings that has a load carrying capacity of about 50,000 pounds and a bar weight of 50 pounds for a ratio of 1000 to 1.

The following table lists the parts numbers and parts descriptions as used herein and in the drawings attached hereto.

PARTS LIST

| Part Number | Description |
|---|---|
| 10 | spreader bar apparatus |
| 11 | crane lifting hook |
| 12 | sling |
| 13 | sling |
| 14 | sling |
| 15 | sling |
| 16 | bar section |
| 17 | bar section |
| 18 | end |
| 19 | end |
| 20 | pin |
| 21 | pin |
| 22 | sling |
| 23 | sling |
| 24 | enlarged diameter section |
| 25 | enlarged diameter section |
| 26 | reduced diameter section |
| 27 | reduced diameter section |
| 28 | enlarged diameter section |
| 29 | enlarged diameter section |
| 30 | annular transverse face |
| 31 | annular transverse face |
| 32 | annular transverse face |
| 33 | annular transverse face |
| 34 | externally threaded projecting portion |
| 35 | internally threaded socket |
| 36 | externally threaded projecting portion |
| 37 | internally threaded socket |
| 38 | body |
| 39 | plate |
| 40 | plate |
| 41 | plate |
| 42 | plate |
| 43 | transverse annular face |
| 44 | internally threaded socket |
| 45 | circular transverse face |
| 46 | circular transverse face |
| 47 | flat surface |
| 48 | opening |
| 49 | plate |
| 50 | plate |
| 51 | plate |
| 52 | plate |
| 53 | arrow |
| 54 | arrow |
| 55 | arrow |
| 56 | projecting connecting portion |
| 57 | circular transverse face |
| 58 | body |
| 59 | annular transverse face |

The foregoing embodiments are presented by way of example only; the scope of the present invention is to be limited only by the following claims.

What is claimed is:

1. A spreader bar apparatus comprising:

a) a pair of bar sections that are connectable end-to-end to form a lifting bar with a bar central longitudinal axis;

b) left and right bar end members each removably attachable to the lifting bar;

c) a plurality of transverse mating annular faces provided on both the bar sections and the bar end members for transferring axial load along the bar central axis in between bar sections and bar end members;

d) a plurality of interlocking connecting portions provided respectively on the bar sections and bar end members and spaced radially from the mating faces, for forming detachable connections between bar sections and between a bar end member and a bar section; and e) wherein load transfer occurs at the transverse mating faces between the bar and bar end members.

2. The spreader bar apparatus of claim 1 wherein the bar has a load carrying capacity and a bar weight and the ratio of load carrying capacity to bar weight is at least one thousand to one.

3. The spreader bar apparatus of claim 2 wherein the bar and bar end members are of a material having a density of less than 400 lbs. per cubic foot.

4. The spreader bar apparatus of claim 2 wherein the bar sections and bar end members are of an aluminum material.

5. The spreader bar apparatus of claim 1 wherein the bar has a load carrying capacity and a bar weight and the ratio of load carrying capacity to bar weight is between about 800 to 1 and 1200 to 1.

6. The spreader bar apparatus of claim 5 wherein the bar and bar end members are of a material having a density of less than 300 lbs. per cubic foot.

7. The spreader bar apparatus of claim 5 wherein the bar and bar end members are of a material having a density of less than 200 lbs. per cubic foot.

8. The spreader bar apparatus of claim 3 wherein the bar sections and bar end members are of an aluminum material.

9. The spreader bar apparatus of claim 1 wherein the connecting portions include threaded connections.

10. The spreader bar apparatus of claim 1 further comprising pins carried by each end member that enables slings to be rigged to the bar end members.

11. A spreader bar apparatus comprising:

a) a pair of bar sections that are connectable end-to-end to form a lifting bar with a bar central longitudinal axis:

b) left and right bar end members each removably attachable to the lifting bar;

c) a plurality of transverse annular faces provided respectively on the bar sections and bar end members for transferring axial load along the bar central axis in between bar sections and bar end members; and d) a plurality of connecting portions provided respectively on the bar sections and bar end members for forming detachable connections between bar sections and between a bar end member and a bar section.

wherein the connecting portions include corresponding internal and external threaded portions that engage upon assembly.

12. The spreader bar apparatus of claim 11 wherein the annular faces carry more axial load than the threads.

13. The spreader bar apparatus of claim 12 wherein the annular faces carry substantially all of the axial load.

14. A spreader bar apparatus comprising:

a) a segmented bar body that includes a central portion and left and right end portions;

b) the segmented bar body comprising at least a pair of bar sections including at least a left bar section and a right bar section, the bar sections being connectable together end-to-end at a central connection near the central portion of the bar body and detachable at said central connection;

c) a left end member that is removably connectable at an end connection to the left end portion of the bar body;

d) a right end member that is removably connectable at an end connection to the right end portion of the bar body;

e) the central connection and end connections including threaded engaging portions that assemble each end member to a bar section; and f) corresponding transverse engaging surfaces are spaced radially from the end connections and that carry substantially all of the axial load at the interface between each end member and its bar section so that the threaded engaging portions are protected from axial load damage during a lift.

15. The spreader bar apparatus of claim 14 wherein the bar body and end members are each of a naterial having a density of less than 400 lbs. per cubic foot.

16. The spreader bar apparatus of claim 14 wherein the bar body and end members are each of a naterial having a density of less than 300 lbs. per cubic foot.

17. The spreader bar apparatus of claim 14 wherein the bar body and end members are each of a naterial having a density of less than 200 lbs. per cubic foot.

18. A spreader bar apparatus comprising:

a) a pair of bar sections that are connectable end-to-end to form a lifting bar with a bar central longitudinal axis;

b) left and right bar end members each removably attachable to the lifting bar;

c) a plurality of transverse annular faces provided respectively on the bar sections and bar end members for transferring axial load along the bar central axis in between bar sections and bar end members; and d) a plurality of connecting portions provided respectively on the bar sections and bar end members for forming detachable connections between bar sections and between a bar end member and a bar section wherein the end members include openings for holding a pin to which rigging can be attached.

19. A spreader bar assembly for use with a lift line and a plurality of slings, comprising:

a) a rigid elongated support bar having first and second end portions;

b) a pair of end members, each removably connectable to the respective end portions of said bar;

c) the end members having pins for forming a connection with above supporting slings and at least one depending lift line;

d) each of said end members and said bar including interlocking sockets and projecting portions for forming interlocking connections between each end member and said bar;

e) a plurality of spaced apart, longitudinally extending plates that extend away from each end member and bar; and f) the pins including one pin extending between inside surfaces of the plates and a pair of pins extending respectively from the outside surface of a plate.

20. The spreader bar assembly of claim 19 wherein said bar and each of said sockets are cylindrical.

21. The spreader bar assembly of claim 19 wherein said sockets are of an internal diameter equal to or slightly larger than the external diameter of said bar.

22. A spreader bar assembly for use with a lift line and a plurality of slings, comprising:

a) a rigid elongated support bar having first and second end portions;

b) a pair of end members, each removably connectable to the respective end portions of said bar;

c) the end members having pins for forming a connection with above supporting slings and at least one depending lift line;

d) each of said end members and said bar including sockets and projecting portions for forming connections between each end member and said bar;

e) a plurality of spaced apart, longitudinally extending plates that extend away from the end member and bar; and f) the pins including one pin extending between inside surfaces of the plates and a pair of pins extending respectively from the outside surface of a plate wherein there is at least one opening in two of said plates receptive of the pin.

23. A spreader bar assembly comprising:

a) a rigid elongated support bar;

b) a pair of removable end caps, each removably connected to a respective end portion of the bar, each end cap forming a connection with an above supporting bridle line and at least one depending lift line, each of said end cap comprising:

a generally cylindrically shaped body;

a plurality of spaced apart, parallel vertical plates affixed rigidly to each body and extending away from the bar during use;

an opening in at least some of the plates; and a single pin that fits the openings of at least two plates, the single pin connecting to both a bridle line and a depending lift line.

24. The spreader bar assembly of claim 23 wherein the end cap has a cylindrical side wall.

25. A spreader bar assembly for use with a bridled load line and depending lift lines comprising:

a) an elongated integral bar of generally uniform cross-section;

b) a pair of end members connected during a lifting operation to each respective end portion of the bar and forming a connection therewith, each of the end members comprising:

a body;

a plurality of spaced apart, parallel generally vertical plates integral with the body and extending away from the end member and the bar, each plate having an opening;

a pin that extends through the plates at the openings for connecting the bridle line to each end member at a position in between two of the plates, and a depending lift line being supported by each pin respectively.

26. The spreader bar of claim 25 wherein the end member is cylindrical.

27. The spreader bar apparatus of claim 26 wherein at least one end member has a socket that receives a projecting portion of the bar.

28. The spreader bar apparatus of claim 25 wherein each of said end members provides at least three of said plates.

29. The spreader bar apparatus of claim 25, wherein said plates are generally parallel.

30. The spreader bar apparatus of claim 25 wherein said elongated bar is a single integral, structural member.

31. The spreader bar apparatus of claim 25 wherein said elongated bar is comprised of a plurality of connectable sections.

32. A spreader bar assembly comprising:

a) a rigid elongated support bar;

b) a pair of end caps, each removably connected during a lifting operation to the respective end portions of said bar;

c) each of the end caps having at least one pin for forming a connection with an above supporting sling and at least one depending lift line, each of said end caps and said bar including socket and projecting portions for connecting one end of said bar to an end cap;

d) each end cap having a plurality of spaced apart, longitudinally extending plates that extend away from the end cap and bar;

e) the pins being connected to the longitudinal plates by spanning between plates.

33. The spreader bar of claim 32 wherein there are at least three plates.

* * * * *